United States Patent [19]

Deters

[11] 4,019,836

[45] Apr. 26, 1977

[54] PLASTIC MOTOR-PUMP BASE FOR A SUBMERSIBLE PUMP UNIT

[75] Inventor: Elmer M. Deters, Muscatine, Iowa

[73] Assignee: Weil-McLain Co., Inc., Dallas, Tex.

[22] Filed: Apr. 20, 1976

[21] Appl. No.: 678,534

Related U.S. Application Data

[63] Continuation of Ser. No. 520,650, Nov. 4, 1974, abandoned.

[52] U.S. Cl. ..... 417/360; 417/410; 415/501

[51] Int. Cl.[2] ..... F04B 17/00; F04B 39/12; F04B 47/06

[58] Field of Search ..... 417/410, 424 R, 360, 417/422; 415/501; 29/156.4 R; 92/128; 60/39.09 P; 415/121 G; 210/444, 416 R; 55/527, 528, 510, 492, 496; 166/105.5

[56] References Cited

UNITED STATES PATENTS

| | | | |
|---|---|---|---|
| 2,254,432 | 9/1941 | Lieberman | 417/360 |
| 2,722,892 | 11/1955 | French | 417/422 |
| 3,179,058 | 4/1965 | Meagher | 417/360 |
| 3,188,968 | 6/1965 | McMahan | 310/87 |
| 3,487,432 | 12/1969 | Jensen | 415/121 G |
| 3,521,970 | 7/1970 | Deters | 417/501 |
| 3,524,550 | 8/1970 | Grant et al. | 210/444 |

*Primary Examiner*—Carlton R. Croyle
*Assistant Examiner*—Thomas I. Ross
*Attorney, Agent, or Firm*—Lane, Aitken, Dunner & Ziems

[57] ABSTRACT

In a submersible deep well pump unit, a plastic fluid intake base coupling the motor to the pump is placed in axial compression over its entire length by means of overlapping bolts respectively connecting the base to the motor and the pump, resulting in a low cost, corrosion and impact resistant pump-motor base.

11 Claims, 5 Drawing Figures

PLASTIC MOTOR-PUMP BASE FOR A SUBMERSIBLE PUMP UNIT

This is a continuation, of application Ser. No. 520,650 filed Nov. 4, 1974, now abandoned.

BACKGROUND OF THE INVENTION

The invention relates generally to fluid pump apparatus, and more particularly to a suction manifold or fluid intake base connecting a pump to a motor, particularly in a deep well pump unit.

It is conventional in submersible pump units to couple the motor to the intake end of an in-line pump by means of a base member, made of cast iron for example, having lateral fluid inlet openings surrounding an axial opening through which the rotor and pump drive shafts are coupled. Besides the necessary passageways in the configuration of the pump-motor base, it is also desirable for the base to be as corrosion resistant as possible while having high strength and especially high resistance to impact. Because of its intermediate location between the pump and motor housings, the base potentially presents a weak link easily fractured by dropping one end of the pump unit during handling or shipping, for example. However, corrosion resistant materials which have good strength properties like brass or stainless steel are costly.

Examples of prior art base units of general interest are found in U.S. Pat. Nos. 2,960,937 to Wright et al, 3,234,886 to Leff and 3,437,045 to Tremain. A plastic base with an integral strainer screen is shown in U.S. Pat. No. 3,521,970 to Deters assigned to the asignee of the present application. While the plastic base in the latter patent provides many desirable qualities, the base itself is placed under axial tension because of the weight of the motor components suspended therefrom. The base or suction manifold is threadably received in the end of the pump housing and the opposite end of the base is bolted to the motor. U.S. Pat. No. 3,188,968 to McMahan shows a different type of pump unit, referred to as a close-coupled pump unit, having a thin back plate member 20, as shown in FIGS. 1 and 3, which appears to be placed in compression by means of long capscrews or tie rods 23. The back plate is not plastic, however, and apparently has no intake openings.

SUMMARY OF THE INVENTION

The general purpose of the invention is to provide a low cost, corrosion and impact resistant pump-motor base. According to the invention, in a submersible deep well pump unit, a plastic fluid intake base coupling the motor to the pump is placed in axial compression by means of overlapping sets of bolts respectively securing the base to the pump and to the motor. Unlike the conventional design in U.S. Pat. No. 3,437,045, for example, in which a nonplastic material is apparently used for the base, the bearing surfaces against which the heads or nuts seat to connect the base to the pump, according to the invention, are located between the motor and the bearing surfaces against which the bolt-heads or nuts seat to secure the base to the motor. In other words, the bolts or threaded studs axially overlap in contrast to the spatial separation between the bolts shown in FIG. 2 of U.S. Pat. No. 3,437,045.

DESCRIPTION OF THE PREFERRED EMBODIMENT

Figure 1:
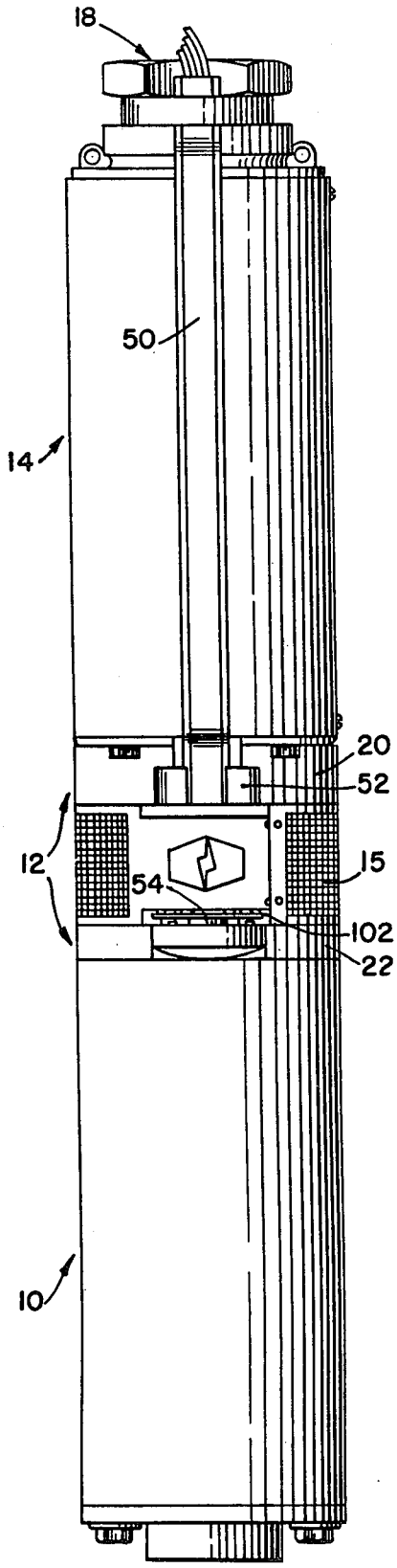
FIG. 1 is a side view of a submersible pump unit in elevation.
Figure 2:
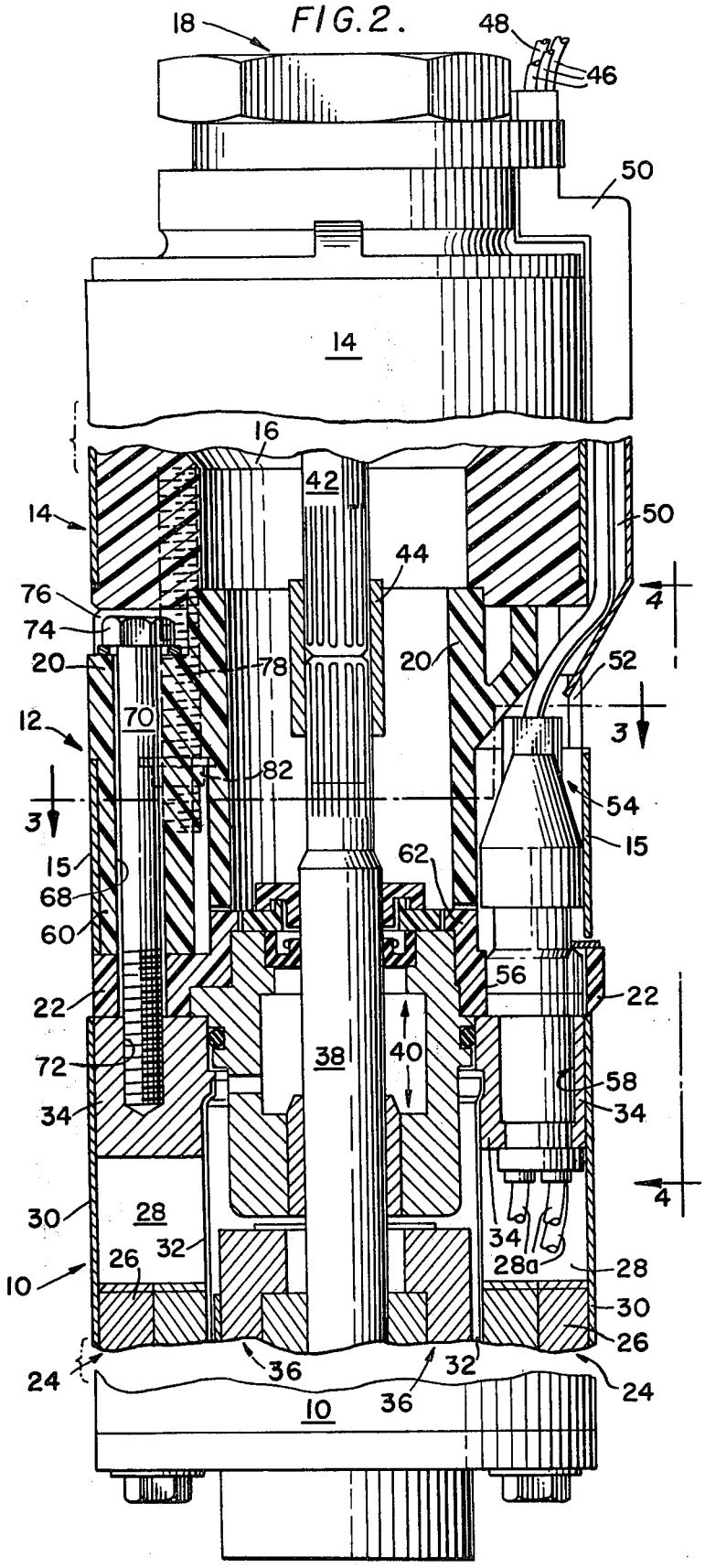
FIG. 2 is an enlarged sectional view of the unit taken along the lines 2—2 of FIG. 3 with portions in elevation.

A submersible pump motor 10 is connected by means of a plastic pump-motor base 12 in line with a multistage centrifugal fluid pump 14, as shown in FIG. 1. The elongated shape of the pump and motor assembly is to permit insertion in a cylindrical well casing with adequate clearance (not shown). As shown in FIG. 2, water or other fluid is sucked through a removable strainer 15 strapped around openings in the base 12 and then through an interior axial pump inlet 16. After passing through the pump 14, the fluid is exhausted through the axial pump outlet 18 to a drop pipe or delivery pipe (not shown) which rises through the well casing to the surface. The base 12, described in detail below, includes an upper portion 20 which is bolted to the bottom part of the pump 14. At the other end of the base 12, a base end plate 22 is affixed to the motor 10 by means of long capscrews extending through the upper portion 20 and base plate 22 into the motor housing.

The motor 10 has a stator assembly 24 including the stator core 26 and stator windings 28 (not shown). The stator assembly is sealed in an annular enclosure formed by a cylindrical inner liner 32 and steel end rings 34 (one shown in FIG. 2) to close the open ends of the annular volume in which the stator core and windings 26 and 28 reside. The interior of the stator assembly 24 occupied by the windings 28 is normally potted in a filling and insulating material (not shown).

The rotor portion 36 of the motor 10 is disposed coaxially within the stator assembly 24 and includes electrical elements (not shown) to cooperate with the stator in driving a rotor shaft 38. The output end of the shaft 38 extends through a sealed bearing assembly 40 flanged to be mounted and retained on the stator end ring 34 by means of the base 12. The output end of the rotor shaft 38 termimates within the base 12 in abutting alignment with a pump shaft 42 connected to centrifugal pump elements (not shown) operative to pump fluid between the inlet 16 and outlet 18. The splined ends of the rotor shaft 38 and pump shaft 42 are drivingly connected by a sleeve coupling 44.

Power is furnished to the pump motor 10 via three power wires 46. An optional fourth wire 48 serves as a safety ground wire, if desired. The wires 46 and 48 extend from the surface downwardly in the space between the drop pipe and the inner wall of the well casing (not shown), alongside the pump 14 through a cable guard 50 affixed to the outside of the pump, through a cable guard retainer 52 in the base 12, and finally to a fluid-tight electrical connector assembly 54. The connector assembly 54 is recieved in aligned stepped openings or bores 56 and 58 formed near the radial extremity of the base plate 22 and the stator ring 34, respectively, in order to provide electrical interconnection between the wires 46 and the interior leads 28*a* for the stator windings 28. The details of the connector assembly 54 are fully described in U.S. Pat. No. 3,952,218. by Elmer Deters entitled "Grounded Electrical Connector for Submersible Apparatus," incorporated herein by reference.

Figure 5:
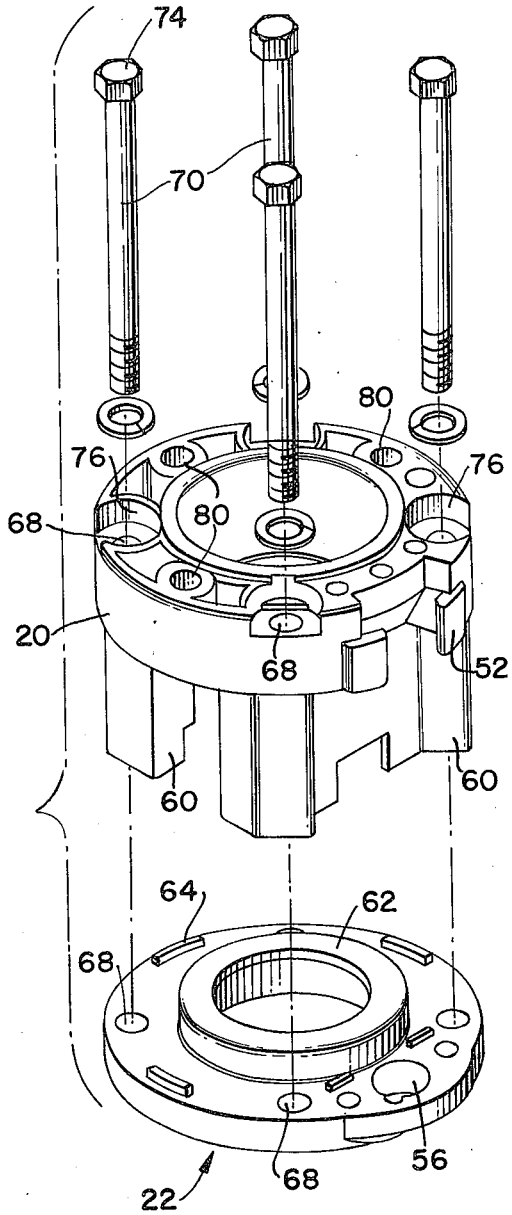
FIG. 5 is an axially exploded perspective view of the pump-motor base.

The base 12, preferably made of a tough, high strength plastic known as Celcon (trademark), is injection-molded in two parts, as shown in the exploded view in FIG. 5, namely the ring-shaped head portion 20 with four depending legs 60 and the base plate 22. The base plate 22 is in the form of an annular ring with a raised circular inner lip 62. The outer ring portion of the base plate 22 has a keyed opening or bore 56 for receiving the connector assembly 54 in proper registry and three raised guides 64 for the strainer screen 15. The legs 60 of the head portion 20 have notches 66 which fit over the lip 62 on the base plate 22. The ends of the legs 60 are ultrasonically welded or otherwise bonded to the base plate 22. Except for the two legs 60 adjacent the bore 56 for the connector assembly 54, the spaces between the legs 60 are open to provide lateral inlets which serve together as a suction manifold for the pump 14.

Figure 3:
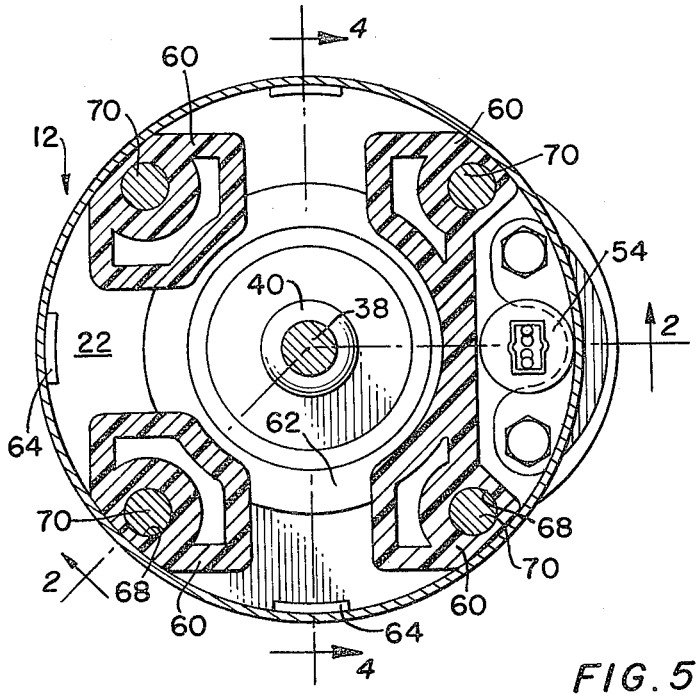
FIG. 3 is a sectional view taken through the pump-motor base along lines 3—3 of FIG. 2.

Four elongated bores 68 are formed through the upper portion 20, depending legs 60, respectively, and the base plate 22 as shown in FIGS. 2, 3 and 5. Four long capscrews 70 are passed through the bores 68 and received in threaded bores 72 in the stator ring 34. The headed ends 74 of the capscrews 70 are seated against bearing surfaces in recesses 76 in the top of the head portion 20. The capscrews 70 secure the pump-motor base 12 to the motor 10. Tightening the capscrews 70 places the pump-motor base 12 under axial compression thus increasing its strength.

To attach the pump-motor base 12 to the pump 14 three threaded studs 78 axially protruding from the inlet end of the pump 14 extend through corresponding through-bores 80 in the head portion 20. The head portion 20 is secured against the underside of the pump 14 by nuts 82 received on the threaded ends of the studs 78 and seated against bearing surfaces on the underside of the head portion 20 in the spaces between the legs 60. Tightening the nuts 82 places the head portion 20, and thus the remainder of the base 12, under axial compression.

Figure 4:
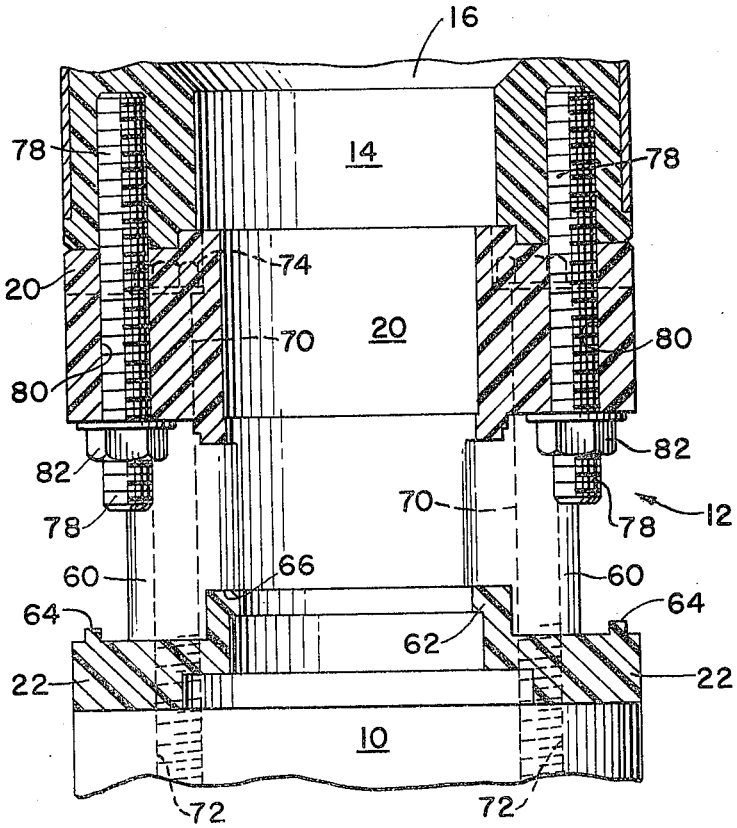
FIG. 4 is a detail sectional view along lines 4—4 of FIG. 3 illustrating the pump-motor base with the pump shaft, rotor shaft and bearing assembly removed.

As seen in FIGS. 2 and 4 the bolts 70 and 78 are arranged to be axially overlapping so as to prevent any axial portion of the base 12 from being placed in tension. As a result, the strength of the plastic base is increased over its entire length with all of the load due to the weight of the motor components being transferred to the capscrews.

Not only is the plastic base 12 corrosion-resistant in chemically aggressive waters, but also impact tests have indicated that the plastic base mounted in axial compression by means of the overlapping bolts is actually stronger than conventional bases constructed of corrosion vulnerable cast iron. Using injection-moldable plastic for the base also results in substantial cost savings over corrosion-resistant metals.

The invention may be embodied in other specific forms without departing from its basic principle. The present embodiment is therefore to be considered in all respects as illustrative and not restrictive, the scope of the invention being indicated by the appended claims rather than by the foregoing description, and all changes which come within the meaning and range of equivalents of the claims are therefore intended to be embraced therein.

I claim:

1. A submersible deep-well pump unit of the type comprising a motor and a pump interconnected by a suction manifold base through which a driving connection between the motor and pump is made, wherein the improvement comprises said base being made of plastic, and fastening means connecting said base to the pump and the motor of placing said base under axial compression over its length to increase its strength.

2. The unit of claim 1, wherein said base has two sets of fastener bearing surfaces, said fastening means including one set of fasteners urging a corresponding set of bearing surfaces toward said pump and another set of fasteners urging the other set of bearing surfaces toward the motor, the set of bearing surfaces urged toward said motor being disposed between the pump and the other set of bearing surfaces.

3. The unit of claim 1, wherein said base includes a first ring-shaped end plate secured to the end of said motor, a second ring-shaped end plate secured to the end of the pump and a plurality of axial legs between said first and second ring-shaped end plates, said legs having axial bores formed therethrough, said fastening means including fasteners extending through said leg bores.

4. The unit of claim 3, wherein said axial legs are integral with one of said ring-shaped end plates, the ends of said legs being bonded to the surface of the other ring-shaped end plate.

5. The unit of claim 4, wherein the ends of said legs are connected to said other ring-shaped end plate by an ultrasonically welded joint.

6. The unit of claim 3, wherein said fasteners have load bearing members, one of said ring-shaped end plates having recesses formed therein coaxially with said leg bores for receiving said respective load bearing members of said fasteners, coaxial bores being formed through said other ring-shaped end plate aligned with said leg bores.

7. The unit of claim 6, wherein said one base plate has a plurality of axial through-bores, said fastening means including other fasteners extending through said through-bores and having load bearing members seated against the underside of said one ring-shaped end plate.

8. The unit of claim 7, wherein said fasteners extending through said leg bores are bolts, the heads of said bolts being received in said recesses, said motor having threaded bores coaxial with said leg bores for receiving the threaded ends of said bolts.

9. The unit of claim 8, wherein said fasteners extending through the through-bores in said one ring-shaped end plate are corresponding threaded studs axially protruding from the end of said pump, said load bearing members being nuts received on the threaded studs and tightened against the underside of said one ring-shaped end plate.

10. The unit of claim 3, wherein said first ring-shaped end plate has formed therein a keyed bore for registrably receiving an electrical connector assembly for said motor.

11. The unit of claim 1, wherein said plastic is a corrosion resistant, injection-moldable plastic.

* * * * *